US008323454B2

(12) United States Patent
Kim et al.

(10) Patent No.: US 8,323,454 B2
(45) Date of Patent: Dec. 4, 2012

(54) METHOD AND DEVICE FOR THE COKING OF HIGH VOLATILITY COAL

(75) Inventors: Ronald Kim, Essen (DE); Franz-Josef Schuecker, Castrop-Rauxel (DE)

(73) Assignee: UHDE GmbH, Dortmund (DE)

( * ) Notice: Subject to any disclaimer, the term of this patent is extended or adjusted under 35 U.S.C. 154(b) by 783 days.

(21) Appl. No.: 12/223,557

(22) PCT Filed: Jan. 24, 2007

(86) PCT No.: PCT/EP2007/000576

§ 371 (c)(1), (2), (4) Date: May 13, 2009

(87) PCT Pub. No.: WO2007/098830

PCT Pub. Date: Sep. 7, 2007

(65) Prior Publication Data

US 2009/0217576 A1 Sep. 3, 2009

(30) Foreign Application Priority Data

Feb. 2, 2006 (DE) ..... 10 2006 005 189

(51) Int. Cl.
*C10B 47/00* (2006.01)

(52) U.S. Cl. ..... 201/1; 201/15; 201/26; 201/27; 201/41; 202/113; 202/227; 202/134; 202/135; 202/248

(58) Field of Classification Search ..... 201/15, 201/26, 27, 41, 1; 202/113, 227, 134, 135, 202/248; 432/185, 190
See application file for complete search history.

(56) References Cited

U.S. PATENT DOCUMENTS

| | | | | |
|---|---|---|---|---|
| 3,912,597 | A | 10/1975 | MacDonald et al. | |
| 4,045,299 | A | 8/1977 | MacDonald | |
| 4,124,450 | A | 11/1978 | MacDonald | |
| 4,287,024 | A | 9/1981 | Thompson | |
| 5,114,542 | A * | 5/1992 | Childress et al. | 201/15 |
| 5,968,320 | A * | 10/1999 | Sprague | 202/113 |
| 6,017,214 | A * | 1/2000 | Sturgulewski | 432/247 |
| 6,596,128 | B2 * | 7/2003 | Westbrook | 202/113 |
| 7,611,609 | B1 * | 11/2009 | Valia et al. | 201/5 |
| 7,998,316 | B2 * | 8/2011 | Barkdoll | 201/39 |

OTHER PUBLICATIONS

Buss, Walter E., et al.; Thyssen Still Otto/PACTI nonrecovery cokemaking system; Iron and Steel Engineer; Jan. 1999; pp. 33-38; vol. 76; No. 1; XP-000799176; Association of Iron and Steel Engineers, Pittsburgh, U.S.

* cited by examiner

*Primary Examiner* — Nina Bhat
(74) *Attorney, Agent, or Firm* — Marshall & Melhorn, LLC

(57) ABSTRACT

Described is a method for the coking of coal, in particular coal with a high or alternating volatility, in coking plants comprising coking chambers, according to the non-recovery method or the heat-recovery method. Also described is device, which can be used to carry out said method simply, as the overheating of the coking furnace is prevented by the injection of water vapor. If a battery of coking furnaces is used, the disclosed method can be carried out irrespective of the number of said furnaces.

11 Claims, No Drawings

METHOD AND DEVICE FOR THE COKING OF HIGH VOLATILITY COAL

This application claims benefit under 371 of PCT/EP2007/000576 filed Jan. 24, 2007.

BACKGROUND OF THE INVENTION

This invention relates to a method for coking coal, in particular coal with a high or varying content of volatile matter, in cokemaking plants with coking chambers using the non-recovery process or the heat-recovery process, and furthermore to a device required to implement this process by a very simple method by preventing the coke oven from being overheated by supplying water steam. The method referred to in this application is independent of the number of coke ovens used, provided the latter form a battery.

For cokemaking, the preheated coking chamber of the coke oven is filled with a coal bed and closed thereafter. The said coal bed may consist of either a bulk coal charge or a compacted, stamped coal charge. Heating the coal causes a volatilization of the volatile matter contained in the coal, i.e. primarily hydrocarbons. The heat further obtained in the coking chamber of non-recovery coke ovens and heat-recovery coke ovens is exclusively generated by combustion of the volatile coal constituents released that volatilize successively by the advancing heating process.

In conformity with prior art technology, combustion is controlled so as to ensure that part of the released gas which is also denoted as crude gas burns off in the coking chamber directly above the coal charge. Combustion air required for this purpose is aspirated through opening ports in the coke oven doors and oven roof. This combustion stage is also denoted as the 1st air stage or primary air stage. Usually the primary air stage does not lead to a complete combustion. Heat liberated during combustion reheats the coal bed, with an ash layer forming on its surface after a short time. This ash layer provides for an exclusion of air, thus preventing a burn-off of the coal bed in the further course of the cokemaking process. Due to heat radiation from above through the developing ash layer, part of the heat liberated during combustion is transferred into the coal charge. Another part of the generated heat is transferred, predominantly by heat conduction through bricked coke oven walls, into the coal bed. A mere heating of the coal bed from the top, applying just a single air stage, however, would lead to uneconomically long coking times.

Therefore, the crude gas which is partially burnt at the primary air stage, is burnt at another stage, thereby supplying heat to the coal bed from the bottom or from the side. There are two technologies particularly known from prior art: U.S. Pat. No. 4,124,450, in conjunction with patents U.S. Pat. No. 4,045,299 and U.S. Pat. No. 3,912,597 of the same inventor, describes how to pass the hot mixture of combustion waste gas and partially burnt crude gas into channels beneath the coking chamber where it can dissipate part of its heat to the brickwork located under the coal bed and transferring this thermal energy by heat conduction to the coal. A post-combustion in a recuperatively operated combustion chamber arranged between the side walls of the coking chamber is executed in the further course of flow. Due to thermal conduction, the heat generated there is laterally transferred via the coke oven walls to the coal bed, thereby reducing the coking time substantially. Such a combustion stage is also denoted as 2nd air stage or secondary air stage.

The other prior art technology supplies the gas partially burnt at the primary stage via channels located in the coke oven walls and also denoted as "downcomers" to the heating flues in the oven sole beneath the coking chamber where sufficient combustion air is continually aspirated to achieve complete combustion. As a result hereof, the coal charge is supplied with heat both directly by heat radiation from the top and indirectly by heat conduction from the bottom, thereby increasing the coking rate and the oven throughput rate substantially.

According to the prior state of the art in technology, the flue gases evolving as a result of a two-stage combustion in the coke oven are subsequently passed through flue gas channels situated outside the coke oven towards the stack and there they can be evacuated into the atmosphere, as provided for in the non-recovery process, or, in case of the heat-recovery process, they can be passed on, for example, to another plant unit to generate steam.

It turned out to be problematic that the release of volatile coal constituents does not proceed uniformly throughout the coking time. At the beginning of cokemaking, a drop in coke oven room temperature is to be recorded. This is caused by the coal charging procedure, because coal is charged at ambient temperature into the warm coke oven chamber. Subsequently it follows a phase of a violent release of gas of high calorific value. This instant supply of heat in the coke oven can be absorbed by the coal and the coke oven construction materials at a limited speed only. Therefore, the temperature in the coke oven chamber rises in the course of the cokemaking process, and if the charging coal blend has a high content of volatile matter, this may lead to exceeding the limit application temperatures of implemented construction materials of the coke oven or flue gas channels and plant units located further downstream. In the further course of coking time, the release of volatile coal constituents becomes increasingly weaker.

According to the prior state of the art in technology, the temperature in a coke oven is only controlled and regulated in the process by controlling and regulating the volumetric flow of primary and secondary air. It bears a drawback in that an effect on the reaction of cokemaking itself is thus taken, because oxygen contained in primary or secondary air acts as a reaction partner and because its over-stoichiometric or under-stoichiometric presence leads to different combustion stages.

To avoid such problems and to assure a most even heat generation and coke quality possible, a coal blend of several individual coal constituents is charged into the coke oven. The coal blend is conventionally adjusted so as to limit the content of volatile matter by a certain maximum value. As a substantial portion of the coal resources available worldwide fails to satisfy this criterion, the availability of coal suitable for this cokemaking process is restricted by this approach, thus leading to economic drawbacks.

BRIEF SUMMARY OF THE INVENTION

Now, therefore, it is the object of this invention to provide an improved method posing no restrictions to coal with regard to its content of volatile matter, leading to a reduction in the burden of nitric oxides in flue gas, and preserving the material of coke ovens without causing any cutback in specific coke throughput rate.

This invention achieves this object as defined in the main claim by applying a method for producing coke in a coking chamber of the non-recovery type or heat-recovery type, wherein the coking chamber is charged with a coal bed and wherein the coal is subsequently heated up, thus providing for a volatilization of volatile coal constituents from the coal, these volatile coal constituents are partially oxidized by means of supplied air (primary air), this gas mixture streams through flue gas channels into the coke oven sole, wherein the channels are arranged in or at the side walls of the coking chamber, and non-burnt, volatile coal constituents are burnt in the coke oven sole, wherein both the coking chamber and the coke oven sole have facilities to restrict the supply of air, with the temperature being measured and water steam being introduced into the coke oven for cooling, if required.

DETAILED DESCRIPTION OF THE INVENTION

An advantageous embodiment of this invention provides for measuring the temperature in the coking chamber and introducing water steam for cooling, if required, into the gas space of the coking chamber, i.e. above the coke cake. In another advantageous variant, water steam is introduced, if required, into the flue gas channels to cool the coke oven sole. This method can be further optimized by applying these two variants jointly.

The method embodying this invention is applied so as to ensure by controlling the feed of water steam that the maximum temperature which the coke oven construction materials are exposed to does not exceed 1400° C. In the method embodying this invention the water steam has an elevated pressure at which it is supplied into the coking chamber and/or flue gas mains. Moreover, the method can be further improved by using relatively cold water steam, the temperature of which lies in a range of 150° C. to 300° C.

While low steam temperatures are important to allow for the greatest possible energy absorption and energy output from the coke oven, it has become evident that water steam must not be introduced with too high a pulse into the coking chamber, because otherwise the ash layer forming above the coke cake or coke charge is abraded. This ash layer serves a significant protective function for the valuable substance as it prevents a burn-off of coal and/or coke in the coke oven.

An improvement resides in introducing water steam jointly with primary air and secondary air, respectively, thus making it possible to diminish the number of opening ports in the coke oven building structure.

This invention also encompasses a coke oven to apply this method in one of the disclosed embodiments, providing opening ports in the coke oven in the coke oven wall or flue gas channels through which water steam can be introduced.

An improvement of the coke oven resides in that a central steam line leads to these opening ports and that several coke ovens are connected to each other. In an improved variant of this coke oven, metering devices designed to vary the required volume of water steam are installed upstream of these opening ports or in the lines, and that these metering devices in turn are connected via control lines to a process computer.

It is not required to introduce this water steam throughout the whole coking time of a coal charge. It is primarily necessary to introduce water steam at the beginning of and during the warm-up phase. When a critical coke oven room temperature is reached, the method described hereinabove is successfully applied to achieve a moderate restraint. As the coke oven temperature can be maintained very precisely at an innocuous though high level by introducing water steam, and since water steam behaves in an inert manner in the coke oven or in the process stages further downstream, the coking process as a whole is accelerated.

Another advantage resides in that particularly those coals considered inferior in view of their especially high content of volatile matter can be advantageously utilized as carbonization accelerators and that upstream process stages for blending of different coal charges can be omitted.

Another embodiment of this method provides for introducing water steam at all times in such a way that coke oven construction materials are never exposed to a temperature higher than 1400° C. In practice, this can be achieved, for example, by installing temperature measurement points at those places of the brickwork structure where much heat is empirically expected to accumulate, and by providing opening ports for introducing water steam in these areas, too.

In an experimental model process, a heat-recovery coke oven was provided with five opening ports that allowed for introducing water steam into the coking chamber. Moreover, all flue gas channels that connect the coking chamber with the coke oven sole were also provided with opening ports that allowed for introducing water steam into the coke oven sole. Steam lines connected with a central main steam line and accommodating one metering device as well as one control element each were laid to all these opening ports. Temperature measurement instruments were arranged in the roof of the coking chamber and at the main crude gas duct which conveys the crude gas from the coke oven sole to the stack. Measured temperature values were transmitted to a process computer which in turn activated the metering devices.

Charged in this experimental process were coal charges having differently high portion of light-volatile constituents which in a conventional coke oven would lead to overheating of and damage to the refractory material. It was managed to control the process and the coke oven at all times in such a way as to prevent any damage to coke oven material or loss of valuable substances.

The invention claimed is:

1. A method for the production of coke in a coking chamber of the "non-recovery type" or "heat-recovery type", comprising charging the coking chamber with a coal bed, heating the coal and volatilizing the volatile coal constituents from the coal charge, partially oxidizing these volatile coal constituents by means of supplied air (primary air), passing these volatile coal constituents and gases through flue gas channels into the coke oven sole, wherein these channels are arranged in or at the side walls of the coking chamber, and non-burnt, volatile coal constituents are burnt in the coke oven sole, wherein both the coking chamber and the coke oven sole have facilities to restrict the supply of air, wherein the temperature is measured, and if the measurement indicates that cooling is required steam is introduced for cooling.

2. A method as defined in claim 1, wherein the temperature is measured in the coking chamber, and if the measurement indicates that cooling is required, the steam is introduced into the gas space of the coking chamber for cooling.

3. A method as defined in claim 1, wherein if the measurement indicates that cooling is required the steam is introduced into the flue gas channels for cooling of the coke oven sole.

4. A method as defined in claim 1, wherein the feed of steam is controlled at all times in such a way that the maximum temperature which the coke oven construction materials are exposed to does not exceed 1400° C.

5. A method as defined in claim 1, wherein the steam is introduced at an elevated pressure.

6. A method as defined in claim 1, wherein the steam has a temperature of 150° C. to 300° C.

7. A method as defined in claim 1, wherein the steam is supplied as steam/air mixtures.

8. A method for the production of coke in a coking chamber of the "non-recovery type" or "heat-recovery type", comprising:

charging the coking chamber with a coal bed, heating the coal and volatilizing the volatile coal constituents from the coal charge, partially oxidizing these volatile coal constituents by means of supplied air (primary air), passing these volatile coal constituents and gases through flue gas channels into the coke oven sole, wherein these channels are arranged in or at the side walls of the coking chamber, and non-burnt, volatile coal constituents are burnt in the coke oven sole, wherein both the coking chamber and the coke oven sole have facilities to restrict the supply of air, wherein the feed of steam is controlled at all times in such a way that the maximum temperature which the coke oven construction materials are exposed to does not exceed 1400° C., and the temperature is measured, and if the measurement indicates that cooling is required steam is introduced for cooling.

9. A device for the production of coke in a coking chamber of the "non-recovery type" or "heat-recovery type" comprising:

a coking chamber, wherein the chamber is charged with a coal bed and the coal is heated and the volatile coal constituents from the coal charge are volatilized;

primary air is supplied which partially oxidizes the volatile coal constituents;

flue gas channels and a coke oven sole, wherein the flue gas channels connect the coking chamber to the coke oven sole wherein the volatile coal constituents and gases pass through the flue gas channels into the coke oven sole;

the coking chamber comprises side walls and the channels are arranged in or at the side walls of the coking chamber;

both the coking chamber and the coke oven sole comprise facilities to restrict the supply of air, wherein the temperature is measured, and if the measurement indicates that cooling is required steam is introduced for cooling; and opening ports allowing for introducing the steam are provided in the coke oven wall or flue gas channels.

10. A device to apply the method as defined in claim 9, wherein a central steam line leads to the coke ovens, wherein branches from the central steam line lead to the opening ports.

11. A device as defined in claim 9, wherein a metering device and a control element for varying the required combustion air volume throughout the coking time are provided at the opening ports.

* * * * *